US006393242B2

(12) United States Patent
Miyashita et al.

(10) Patent No.: US 6,393,242 B2
(45) Date of Patent: May 21, 2002

(54) METAL PIPE FOR USE IN RECORDING APPARATUS

(75) Inventors: Morihiro Miyashita; Yuuichi Hamaguchi, both of Yokohama (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/849,225

(22) Filed: May 7, 2001

(51) Int. Cl.[7] ..... G03G 15/09

(52) U.S. Cl. ..... 399/276; 399/286; 492/18; 29/895

(58) Field of Search ..... 399/265, 276, 399/279, 286, 116, 159, 176, 313, 330, 331, 357; 492/1, 3, 16, 18; 138/177; 29/895, 895.33

(56) References Cited

U.S. PATENT DOCUMENTS 3,894,325 A * 7/1975 Maruta et al. ..... 428/683
4,612,071 A * 9/1986 O'Donnell et al. ..... 72/367
4,823,847 A * 4/1989 Grosse et al. ..... 138/143
4,825,674 A * 5/1989 Tanaka et al. ..... 72/98
5,083,374 A * 1/1992 Miller ..... 29/895.3
5,131,583 A * 7/1992 Matsumoto ..... 228/132

FOREIGN PATENT DOCUMENTS

JP 56-017109 * 2/1981
JP 56-108829 * 8/1981

* cited by examiner

*Primary Examiner*—Robert Beatty
(74) *Attorney, Agent, or Firm*—Sughrue Mion, PLLC

(57) ABSTRACT

A metal pipe excellent in dimensional accuracy, which is suitably used for a development sleeve, a fixing roller, or a photosensitive drum for electrophotographic apparatuses or electrostatic recording apparatuses such as copying machines or printers, or a base body thereof. The metal pipe is produced by cutting a long-sized metal pipe body into a specific length, to obtain a raw pipe, and adjusting the surface state and the dimensional accuracy of the raw pipe by cutting and polishing the outer peripheral surface of the raw pipe, wherein the raw pipe has an inner stress of 20 $N/mm^2$ or less.

18 Claims, 2 Drawing Sheets

METAL PIPE FOR USE IN RECORDING APPARATUS

BACKGROUND OF THE INVENTION

The present invention relates to a metal pipe having an excellent dimensional accuracy with less run-out, which is suitably used for a development sleeve, a fixing roll, or a photosensitive drum for electrophotographic apparatuses or electrostatic recording apparatuses such as copying machines or printers, or a base body thereof, particularly, used for the development sleeve or a base body thereof.

In electrophotographic apparatuses or electrostatic recording apparatuses such as copying machines or printers, development has been performed by visualizing an electrostatic latent image formed on a latent image holder such as a photosensitive drum. According to one known development method, a developer (toner) is supported on the surface of a rotating sleeve in which a magnet roller is previously disposed, and the toner is supplied to the surface of a latent image holder by a so-called jumping phenomenon, to visualize an electrostatic latent image on the latent image holder. The jumping phenomenon is a phenomenon that the toner is flown from the surface of the sleeve, which is disposed in proximity to the surface of the latent image holder, onto the surface of the latent image holder by a magnetic force characteristic of the magnet roller. Further, there is known another method in which development is performed in a non-contact state that the surface, on which toner is supported, of a sleeve is spaced from the surface of a latent image holder by a specific gap like the above-described development method utilizing the jumping phenomenon, for example, a two-component development method using a two-component developer, or a magnetic brush development method of forming a magnetic brush with a developer (toner) between the surfaces of a sleeve and a latent image holder, and supplying the toner onto the latent image holder by bringing the magnetic brush into contact with the surface of the latent image holder.

The sleeve used for the above-described development methods has been produced by cutting a long-sized metal pipe body into a specific length, to obtain a raw pipe, and adjusting the surface state and the dimensional accuracy of the raw pipe by cutting and polishing the outer peripheral surface of the raw pipe.

By the way, with respect to the above-described development sleeve used for development mechanism portions of electrophotographic apparatuses or electrostatic recording apparatuses such as copying machines or printers, the dimensional accuracy thereof exerts a large effect on an image obtained by using the sleeve. According to the development method using the sleeve, as described above, development is performed by supplying toner from the surface of the sleeve onto an electrostatic latent image held on a latent image holder such as a photosensitive drum by utilizing the so-called jumping phenomenon in which the toner is flown from the surface of the sleeve, which is disposed in proximity to the latent image holder, to the surface of the latent image holder, or by bringing a magnetic brush of the toner formed on the surface of the sleeve into contact with the latent image holder. Accordingly, the sleeve and the latent image holder such as a photosensitive drum must be rotated with a gap between the surfaces thereof usually kept constant. If the gap between the surfaces of the sleeve and the latent image holder varies during development, the amount of toner supplied by the jumping phenomenon or magnetic brush correspondingly varies, resulting in an image failure such as inconsistencies in density.

For this reason, it is apparent that the dimensional accuracy of a sleeve exerts a large effect on an image formed by using the sleeve. In particular, to keep constant the gap between the surfaces of a rotating sleeve and a rotating latent image holder, it is very important to enhance both the roundness of the outer periphery of the sleeve and the straightness of the center axis of the sleeve. In this regard, according to the prior art, as described above, the surface state and the dimensional accuracy of a sleeve have been adjusted by cutting and polishing the outer peripheral surface of the raw pipe.

Such a prior art method, however, has failed to obtain a sleeve having a sufficient dimensional accuracy, and it has been required to further improve the dimensional accuracy of a sleeve, particularly, the roundness and straightness of the sleeve.

In addition to the above-described development sleeve, a base body of a photosensitive drum as a latent image holder or a fixing roll used for electrophotographic apparatuses or electrostatic recording apparatuses has been formed by a metal pipe produced by the same method as that of producing a metal pipe for the development sleeve. The dimensional accuracy of the metal pipe used for such a photosensitive drum or fixing roll also exerts a large effect on the performance of the photosensitive drum or fixing roll. Accordingly, it has been required to improve the dimensional accuracy of the metal pipe used for a photosensitive drum or fixing roll.

SUMMARY OF THE INVENTION

An object of the present invention is to provide a metal pipe excellent in dimensional accuracy, which is suitably used for a development sleeve, a fixing roller, or a photosensitive drum for electrophotographic apparatuses or electrostatic recording apparatuses such as copying machines or printers, or a base body thereof.

To achieve the above object, the present inventor has studied to improve the dimensional accuracy of a metal pipe used for a development sleeve or a base body thereof, produced by cutting a long-sized metal pipe body into a specific length, to obtain a raw pipe, and cutting and polishing the outer peripheral surface of the raw pipe, and has found that the dimensional accuracy, particularly, each of the roundness and straightness of the metal pipe is affected not only by the machining accuracy at the time of production of the metal pipe but also largely affected by physical properties of the raw pipe before being cut and polished, particularly, the inner stress characteristic of the raw pipe in the state being cut and polished, and that a metal pipe excellent in dimensional accuracy, particularly, excellent in roundness and straightness and thereby less in run-out can be certainly produced by cutting and polishing a raw pipe less in inner stress, and therefore, a high performance development sleeve excellent in dimensional accuracy can be obtained by using such a metal pipe excellent in dimensional accuracy.

On the basis of the above knowledge, the present inventor has measured physical properties of a raw pipe used for production of a metal pipe constituting a development sleeve and examined the effects of the physical properties of the raw pipe on the dimensional accuracy of the metal pipe produced by cutting and polishing the raw pipe, and found that the inner stress present in the raw pipe in the state being cut and polished is reduced after being cut and polished, that is, the stress remaining in the raw pipe is relieved by cutting and polishing, and thereby the dimensional accuracy adjusted by cutting and polishing is enhanced by relief of the inner stress.

As a result of further examination, the present inventor has found that a desirable dimensional accuracy of a metal pipe produced by cutting and polishing a raw pipe can be certainly obtained by setting the inner stress of the raw pipe in the state before being cut and polished to 20 N/mm$^2$ or less, and therefore, a high performance development sleeve excellent in dimensional accuracy can be certainly obtained by using such a metal pipe, and eventually, the present inventor has accomplished the present invention.

Accordingly, the present invention provides a metal pipe produced by cutting a long-sized metal pipe body into a specific length, to obtain a raw pipe, and adjusting the surface state and the dimensional accuracy of the raw pipe by cutting and polishing the outer peripheral surface of the raw pipe, characterized in that the raw pipe has an inner stress of 20 N/mm$^2$ or less.

DETAILED DESCRIPTION OF THE PREFERRED EMBODIMENT

Figure 1:
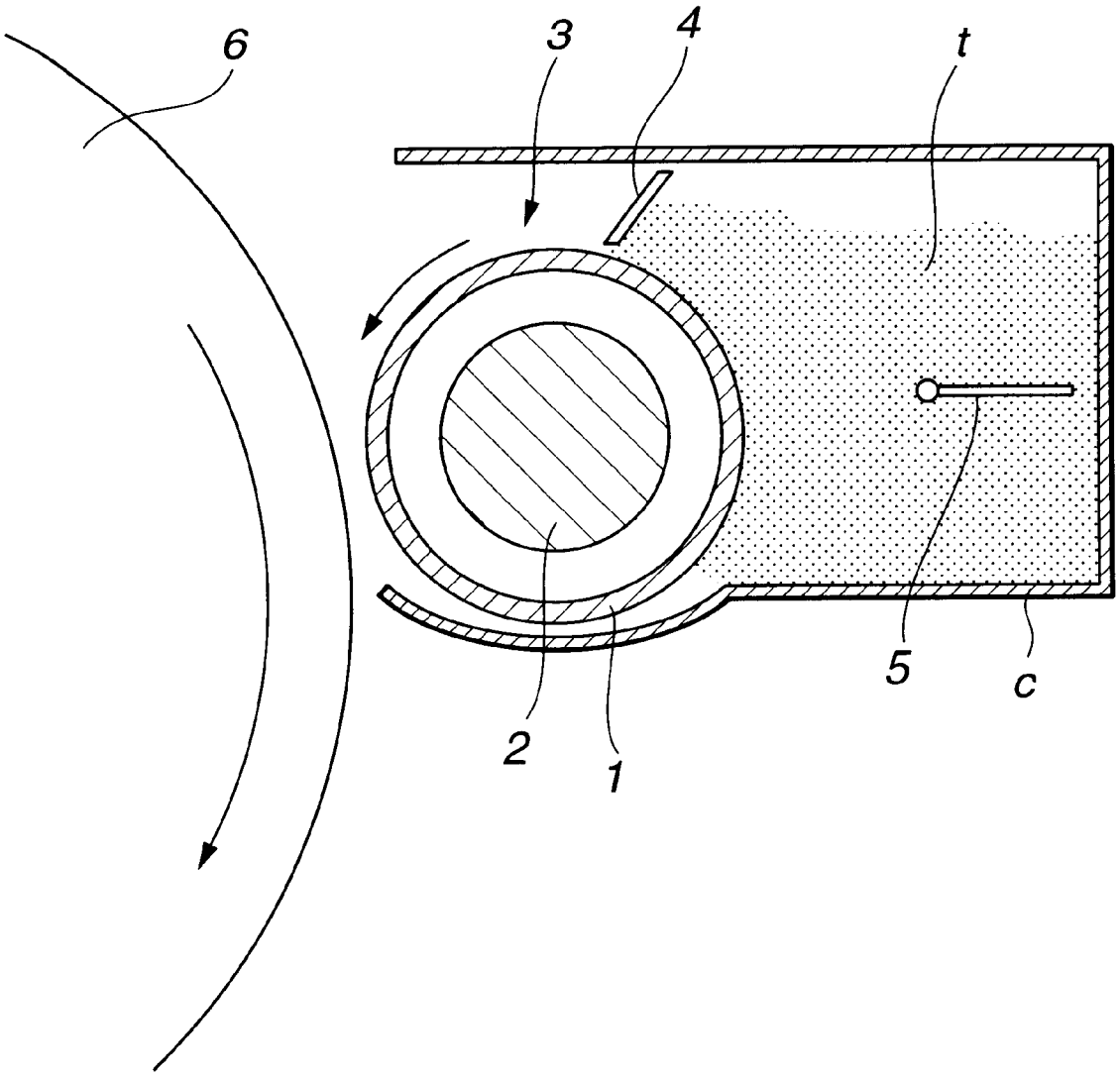
FIG. 1 is a schematic sectional view showing one example of a development apparatus including a development sleeve using a metal pipe of the present invention.

Hereinafter, a preferred embodiment of the present invention will be described in detail with reference to the drawings.

A metal pipe of the present invention is produced by cutting a long-sized metal pipe body into a specific length, to obtain a raw pipe, and adjusting the surface state and the dimensional accuracy of the raw pipe by cutting and polishing the outer peripheral surface of the raw pipe. In this metal pipe, the inner stress of the raw pipe for the metal pipe is specified to be in a range of 20 N/mm$^2$ or less.

As the above-described metal pipe body, there can be used a metal pipe body generally used for development sleeves, for example, an aluminum pipe body, an aluminum alloy pipe body, or stainless steel pipe body. In particular, an aluminum pipe body or an aluminum alloy pipe body is preferably used.

The outside diameter and thickness of the metal pipe body are not particularly limited but may be suitably selected according to the dimensions of a desired development sleeve. According to the present invention, in particular, the outside diameter of the metal pipe body is preferably in a range of 12.1 to 25.3 mm, and the thickness thereof is preferably in a range of 0.5 to 1 mm.

The metal pipe of the present invention is produced by cutting and polishing a raw pipe obtained by cutting the above-described metal pipe body, wherein the inner stress of the raw pipe is specified to be in a range of 20 N/mm$^2$ or less, preferably, 19 N/mm$^2$ or less. The inner stress of the raw pipe may be determined by measuring the inner stress of the metal pipe body before being cut into the raw pipe or measuring the inner stress of the raw pipe obtained by cutting the metal pipe body. It is to be noted that if a treatment for adjusting physical properties, for example, a heat-treatment is applied to the metal pipe body or the raw pipe, the inner stress of the metal pipe body or the raw pipe after the heat-treatment should be measured.

To be more specific, depending on the material of a metal pipe body, physical properties such as a hardness and a tensile strength of the metal pipe body are often adjusted by a heat-treatment. In this case, the heat-treatment may be applied to the metal pipe body or a raw pipe obtained by cutting the metal pipe body. Since such a heat-treatment changes the inner stress of the metal pipe body or the raw pipe, the inner stress of the metal pipe or the raw pipe must be measured after the heat-treatment. That is to say, if the metal pipe body before being cut into the raw pipe is subjected to the heat-treatment, the inner stress of the heat-treated metal pipe body or the raw pipe obtained by cutting the heat-treated metal pipe body should be measured, and if the raw pipe obtained by cutting the metal pipe body is subjected to the heat-treatment, the inner stress of the heat-treated raw pipe should be measured. If neither a metal pipe body nor a raw pipe is subjected to any heat-treatment, the inner stress of either the metal pipe body or the raw pipe may be measured, and in this case, the inner stress of the metal pipe body or the raw pipe may be performed at any time until the raw pipe is cut and polished into a metal pipe.

The metal pipe body used for the present invention is generally produced by extrusion; however, when the metal pipe body having a small thickness is required to be used, to adjust its thickness and the like, the metal pipe body produced by extrusion is further subjected to a drawing treatment. Since the drawing treatment largely varies the inner stress of the metal pipe body, the inner stress of the metal pipe body must be measured after the drawing treatment.

That is to say, according to the present invention, the inner stress of the raw pipe before being cut and polished into the metal pipe is, as described above, specified to be in a range of 20 N/mm$^2$ or less, preferably, 19 N/mm$^2$ or less, and the inner stress of the raw pipe may be measured at any time insofar as the inner stress of the raw pipe before being cut and polished into the metal pipe is determined.

The measurement of the inner stress is not particularly limited but may be suitably performed. For example, the inner stress of a metal pipe body or a raw pipe can be measured by cutting the metal pipe body or the raw pipe into a specific length, for example, about 10 mm, to obtain a sample, measuring the outside diameters, at the cut plane, of the sample before and after being cut, and substituting the outside diameters thus measured in the following equation:

$$\text{inner stress } (\text{N/mm}^2) = \left( \frac{\text{thickness (mm)}}{\text{outside diameter (mm) before cutting}} - \frac{\text{thickness (mm)}}{\text{outside diameter (mm) after cutting}} \right) \times \text{Young Modulus } (\text{kgf/mm}^2) \times 9.8\ (\text{N/kgf})$$

The method of cutting a metal pipe body or a raw pipe into a sample used for measurement of the inner stress thereof is not particularly limited but may be performed in the same manner as that used for cutting the metal pipe body into the raw pipe, concretely, in a general manner using a known cutter such as a band saw machine or a disc cutter.

In the case of producing the metal pipe of the present invention by cutting a long-sized metal pipe body into a specific length, to obtain a raw pipe, and cutting and polishing the outer peripheral surface of the raw pipe, the metal pipe body may be selected so that the inner stress of the raw pipe obtained by cutting the metal pipe body is within the above-described range, that is, 20 N/mm$^2$ or less, preferably, 19 N/mm$^2$ or less. In this case, if the metal pipe body or the raw pipe is subjected to a heat-treatment, the inner stress of the metal pipe body or the raw pipe can be adjusted by controlling the heat-treatment condition. In this way, the metal pipe of the present invention may be produced by adjusting the inner stress of the raw pipe by controlling the heat-treatment.

The metal pipe of the present invention is produced by cutting and polishing the surface of a raw pipe obtained by cutting a metal pipe body. In this case, the cutting and polishing of the raw pipe may be performed depending on the material of the raw pipe by a known method. For example, if the raw pipe is formed of an aluminum pipe or an aluminum alloy pipe, it can be cut and polished by using a cylindrical grinder (centerless grinder) or a lathe.

The metal pipe of the present invention is produced by adjusting the surface state and the dimensional accuracy of a raw pipe. In this case, while not particularly limited, the dimensions of the metal pipe produced by cutting and polishing the raw pipe are preferably set such that the outside diameter thereof is in a range of 12 to 25 mm, the thickness thereof is in a range of 0.4 to 0.9 mm, and the length thereof is in a range of 200 to 400 mm. According to the present invention, a metal pipe having the above-described dimensions, which exhibits an excellent dimensional accuracy with less run-out, for example, in a range of 0.016 mm or less, particularly, 0.015 mm or less can be produced by cutting and polishing a raw pipe, whose inner stress is 20 N/mm$^2$ or less, obtained by cutting a metal pipe body having the above-described dimensions. Such a metal pipe is suitably used for a development sleeve or the like.

Here, the "run-out" of the pipe means a displacement width of the outer peripheral surface of the pipe rotating with both ends thereof supported, and is used for totally evaluating both the roundness and straightness of the pipe. To be more specific, centers of the cross-section of the pipe should be aligned to each other in the longitudinal direction; however, if the cross-section of the pipe is not rounded or the pipe is not straightened, there occur deviations among the centers of the cross-section in the longitudinal direction. According to the present invention, the maximum value of widths of such deviations among the centers of the cross-section of the pipe in the longitudinal direction is called the "run-out". The "run-out" of a pipe can be easily measured by rotating the pipe as described above and measuring the displacement width of the outer peripheral surface of the pipe.

Figure 2A:
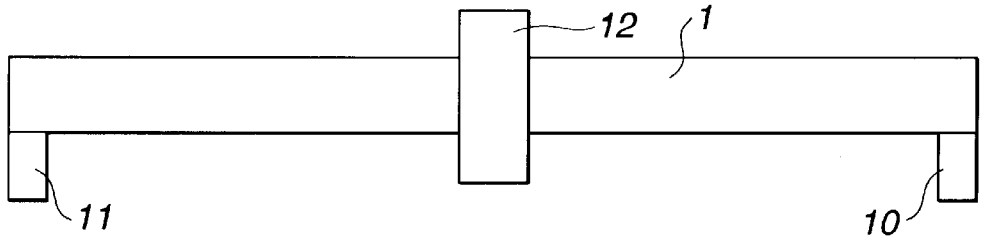
FIGS. 2A to 2D are views illustrating a method of measuring a run-out of a metal pipe used for a development sleeve.
Figure 2B:
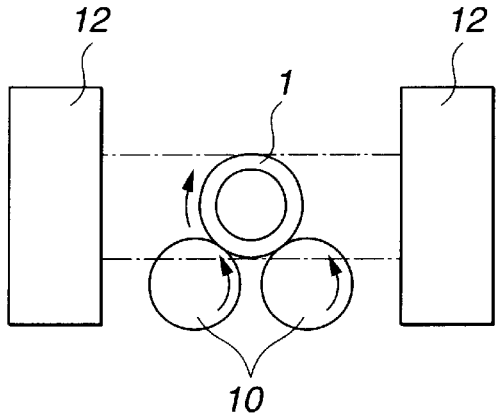
Figure 2C:
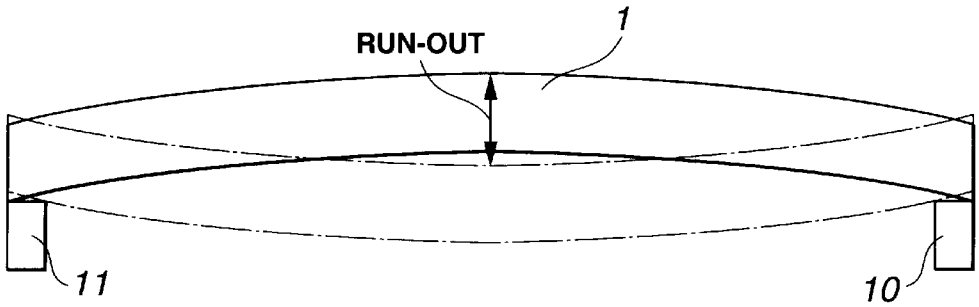
Figure 2D:
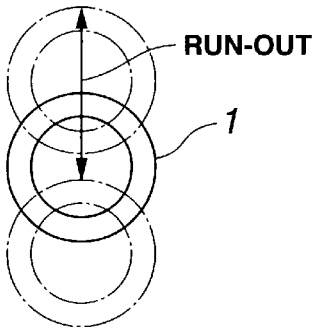

For example, as shown in FIGS. 2A and 2B, both ends of a pipe 1 are supported by a pair of drive rollers 10 and a pair of driven rollers 11, wherein the pipe 1 is rotated by the drive rollers 10 and a displacement of the outer peripheral surface of the pipe 1 is measured by a displacement measuring device 12 using a laser beam or the like. As shown in FIGS. 2C and 2D, the maximum value of the displacement widths of the outer peripheral surface of the pipe 1 is taken as a "run-out" of the pipe 1. The "run-out" of the pipe 1 of the present invention is a value measured at a central portion of the pipe 1 in the length direction, at which the displacement width is maximized.

According to the present invention, as described above, there can be obtained a metal pipe having a significantly excellent dimensional accuracy with less run-out, for example, in a range of 0.016 mm or less. In the case of performing development by rotating a development sleeve formed by a metal pipe, disposed in proximity to a rotating latent image holder such as a photosensitive drum, if the run-out of the metal pipe is specified in the range of 0.016 mm or less, a desirable image can be certainly obtained without occurrence of an image failure due to a variation in gap between the surfaces of the sleeve and the latent image holder.

The metal pipe of the present invention is produced, as described above, by cutting and polishing the outer peripheral surface of a raw pipe having the above-described specific inner stress characteristic, and is suitably used for a development sleeve, a photosensitive drum, or a fixing drum. In this case, the metal pipe can be subjected to an additional machining or treatment as needed. For example, if the metal pipe is used for a development sleeve, to improve the carrying characteristic of toner, the metal pipe can be subjected to a suitable machining or treatment without departing from the scope of the present invention, for example, the a sandblast treatment or a plating treatment on the surface of the metal pipe. Alternatively, the metal pipe used for a development sleeve may be provided with a flange on either or each end surface, or provided with a gear for rotating the sleeve.

As described above, the metal pipe of the present invention is suitably used for a development sleeve, a photosensitive drum, or a fixing roll for electrophotographic apparatuses or electrostatic recording apparatuses such as copying machines or printers. In particular, the metal pipe of the present invention is suitably used for a development sleeve or a photosensitive drum whose dimensional accuracy exerts a large effect on an image. In this case, the development sleeve may be of any type, for example, the above-described jumping type, two-component development type, or magnetic brush development type. One example of a development apparatus of the jumping type using the metal pipe of the present invention as a development sleeve is shown in FIG. 1.

As shown in FIG. 1, the development apparatus includes a development cylinder 3 having a rotatable development sleeve 1 formed of the metal pipe of the present invention and a magnet roller 2 disposed inside the development sleeve 1, and a toner layer formation blade 4 with its tip disposed in proximity to the development sleeve 1, wherein the surface of the sleeve 1 is disposed in proximity to a latent image holder 6 such as a photosensitive drum with a specific gap held therebetween. In this development apparatus, toner "t" contained in a casing "c" is attracted and supported on the surface of the sleeve 1 by a magnetic force of the magnet roller 2, and is then formed into a thin layer having a specific thickness by the toner layer formation blade 4. When the toner "t" in the form of the thin layer is carried to a portion closer to the latent image holder 6 by rotation of the sleeve 1, the toner "t" is filed onto the latent image holder 6 by a magnetic characteristic of the magnet roller 2 and a bias electric field applied between the sleeve 1 and the latent image holder 6, whereby an electrostatic latent image on the surface of the latent image holder 6 is visualized, to develop the electrostatic latent image. In the figure, reference numeral 5 designates a stirring paddle for stirring the toner "t" contained in the casing "c".

Here, since the metal pipe of the present invention has, as described above, an excellent dimensional accuracy with less run-out, the toner can be stably supplied by rotating the sleeve 1 in the state in which the gap between the surface of the development sleeve 1 formed by the metal pipe or using the metal pipe as a base body and the surface of the latent image holder 6 can be always kept constant. As a result, a desirable image can be certainly obtained without occurrence of an image failure due to a variation in gap between the surfaces of the sleeve 1 and the latent image holder 6.

The development apparatus using the metal pipe of the present invention as the development sleeve is not limited to that of the jumping development type shown in FIG. 1 but may be of the two-component development type or the magnetic brush development type. That is to say, the development apparatus using the metal pipe of the present invention may be of any type insofar as the apparatus is configured such that the sleeve and the latent image holder are disposed with a specific gap held therebetween and toner is supplied from the sleeve to the latent image holder. Further, the metal pipe of the present invention are suitably used for a development sleeve, a photosensitive drum, or a fixing roll for electrophotographic apparatuses or electrostatic recording apparatuses, or a base body thereof, but are not limited thereto. For example, the metal pipe of the present invention may be suitably used for another pipe-like member for electrophotographic apparatuses or electrostatic recording apparatuses or a base body thereof, or a pipe-like member required to have a high dimensional accuracy in an application other than electrophotograph or a base body thereof.

EXAMPLES

The present invention will be more clearly understood with reference to, but not limited thereto, the following examples.

Inventive Example and Comparative Examples 1 to 3

Four kinds of aluminum pipe bodies A to D shown in Table 1 were prepared. Each aluminum pipe body was cut into a length of 10 mm, to obtain a sample. The inner stress of the sample was calculated by substituting the outside diameters of the sample before and after being cut, which were measured at the cut plane, in the above-described calculation equation. The measurement was repeated by four times for each sample, and the mean value of the measured values was taken as the inner stress of the sample. The results are shown in Table 1.

Next, each aluminum pipe body was cut into a length of 319 mm in the same manner as that for obtaining the above sample, to obtain a raw pipe, and the raw pipe was cut and polished, to obtain a development sleeve having an outside diameter of 18.0 mm. The run-out of each sleeve was measured in the above-described measurement method. In addition, the measurement was repeated for 30 pieces of samples for each sleeve, and the mean value of the measured values was taken as the run-out of the sleeve. The results are shown in Table 1.

TABLE 1

| Aluminum pipe body | Outside diameter (mm) | Thickness (mm) | Inner stress ($N/mm^2$) | Thickness of sleeve (mm) | Run-out of sleeve (mm) |
|---|---|---|---|---|---|
| A (Inventive Example) | 18.2 | 0.62 | 18.8 | 0.42 | 0.0141 |
| B (Comparative Example 1) | 18.2 | 0.61 | 25.1 | 0.41 | 0.0177 |
| C (Comparative Example 2) | 18.2 | 0.62 | 71.8 | 0.42 | 0.0281 |
| D (Comparative Example 3) | 18.2 | 0.62 | 49.4 | 0.42 | 0.0198 |

As shown in Table 1, the development sleeve (metal pipe) in Inventive Example, which is obtained from the aluminum pipe body A having an inner stress of 18.8 $N/mm^2$ (less than 20 $N/mm^2$ specified according to the present invention), exhibits a run-out of 0.0141 mm (less than 0.016 mm specified according to the present invention), that is, a desirable dimensional accuracy. As a result, it becomes apparent that a development sleeve (metal pipe) excellent in dimensional accuracy, particularly, roundness and straightness can be certainly obtained according to the present invention.

As described above, according to the present invention, it is possible to certainly obtain a metal pipe excellent in dimensional accuracy, which is suitably used for a development sleeve, a fixing roller, or a photosensitive drum for electrophotographic apparatuses or electrostatic recording apparatuses such as copying machines or printers, or a base body thereof.

While the preferred embodiment of the present invention has been described using specific terms, such description is for illustrative purposes only, and it is to be understood that changes and variations may be made without departing from the spirit or scope of the following claims.

What is claimed is:

1. In a metal pipe produced by cutting a long-sized metal pipe body into a specific length, to obtain a raw pipe, and adjusting the surface state and the dimensional accuracy of said raw pipe by cutting and polishing the outer peripheral surface of said raw pipe, the improvement wherein said raw pipe has an inner stress of 20 $N/mm^2$ or less; and said raw pipe has an outside diameter of 12.1 to 25.3 mm and a thickness of 0.5 to 1 mm.

2. A metal pipe according to claim 1, wherein said pipe produced by cutting and polishing said raw pipe has an outside diameter of 12 to 25 mm, a thickness of 0.4 to 0.9 mm, and a length of 200 to 400 mm.

3. A metal pipe according to claim 1, wherein said pipe produced by cutting and polishing said raw pipe has a run-out of 0.016 mm or less.

4. A metal pipe according to claim 1, wherein said long-sized metal pipe body for producing said metal pipe is made from aluminum or an aluminum alloy.

5. A metal pipe according to claim 1, wherein said metal pipe is used for a development sleeve, a fixing roll, or a photosensitive drum for an electrophotographic apparatus or an electrostatic recording apparatus, or a base body thereof.

6. In a development apparatus including a development cylinder having a rotatable sleeve and a magnet roller disposed inside said rotatable sleeve, wherein a developer is supported in the form of a thin layer on the outer peripheral surface of said sleeve of said development cylinder, and in such a state, said development cylinder is rotated in proximity to the surface of a latent image holder holding on its surface an electrostatic latent image, whereby the developer is flown from the surface of said sleeve to the electrostatic latent image on the surface of said latent image holder, to thereby visualize the electrostatic latent image, the improvement wherein said sleeve or a base body thereof comprises a metal pipe produced by cutting a long-sized metal pipe body into a specific length, to obtain a raw pipe, and adjusting the surface state and the dimensional accuracy of said raw pipe by cutting and polishing the outer peripheral surface of said raw pipe, wherein said raw pipe has an inner stress of 20 $N/mm^2$ or less.

7. A development apparatus according to claim 6, wherein said raw pipe has an outside diameter of 12.1 to 25.3 mm and a thickness of 0.5 to 1 mm.

8. A development apparatus according to claim 6, wherein said pipe produced by cutting and polishing said raw pipe has an out-side diameter of 12 to 25 mm, a thickness of 0.4 to 0.9 m, and a length of 200 to 400 mm.

9. A development apparatus according to claim 6, wherein said pipe produced by cutting and polishing said raw pipe has a run-out of 0.016 mm or less.

10. A development apparatus according to claim 6, wherein said long-sized metal pipe body for producing said metal pipe is made from aluminum or an aluminum alloy.

11. In a metal pipe produced by cutting a long-sized metal pipe body into a specific length, to obtain a raw pipe, and adjusting the surface state and the dimensional accuracy of said raw pipe by cutting and polishing the outer peripheral surface of said raw pipe, the improvement wherein said raw pipe has an inner stress of 20 $N/mm^2$ or less; and said pipe produced by cutting and polishing said raw pipe has an outside diameter of 12 to 25 mm, a thickness of 0.4 to 0.9 mm, and a length of 200 to 400 mm.

12. In a metal pipe produced by cutting a long-sized metal pipe body into a specific length, to obtain a raw pipe, and adjusting the surface state and the dimensional accuracy of said raw pipe by cutting and polishing the outer peripheral surface of said raw pipe, the improvement wherein said raw pipe has an inner stress of 20 $N/mm^2$ or less; and said pipe produced by cutting and polishing said raw pipe has a run-out of 0.016 mm or less.

13. In a metal pipe produced by cutting a long-sized metal pipe body into a specific length, to obtain a raw pipe, and adjusting the surface state and the dimensional accuracy of said raw pipe by cutting and polishing the outer peripheral surface of said raw pipe, the improvement wherein said raw pipe has an inner stress of 20 $N/mm^2$ or less; and said long-sized metal pipe body for producing said metal pipe is made from aluminum or an aluminum alloy.

14. In a metal pipe produced by cutting a long-sized metal pipe body into a specific length, to obtain a raw pipe, and adjusting the surface state and the dimensional accuracy of said raw pipe by cutting and polishing the outer peripheral surface of said raw pipe, the improvement wherein said raw pipe has an inner stress of 20 $N/mm^2$ or less; and said metal pipe is used for a development sleeve, a fixing roll, or a photosensitive drum for an electrophotographic apparatus or an electrostatic recording apparatus, or a base body thereof.

15. A metal pipe according to claim 14, wherein said raw pipe has an outside diameter of 12.1 to 25.3 mm and a thickness of 0.5 to 1 mm.

16. A metal pipe according to claim 14, wherein said pipe produced by cutting and polishing said raw pipe has an outside diameter of 12 to 25 mm, a thickness of 0.4 to 0.9 mm, and a length of 200 to 400 mm.

17. A metal pipe according to claim 14, wherein said pipe produced by cutting and polishing said raw pipe has a run-out of 0.016 mm or less.

18. A metal pipe according to claim 14, wherein said long-sized metal pipe body for producing said metal pipe is made from aluminum or an aluminum alloy.

* * * * *